United States Patent [19]

Brewer et al.

[11] 4,360,304

[45] Nov. 23, 1982

[54] EXTENDABLE CRANE TROLLEY AND METHOD

[75] Inventors: Bruce L. Brewer, Alliance; Brooks E. Weingart, Sebring, both of Ohio

[73] Assignee: Amca International Corporation, Hanover, N.H.

[21] Appl. No.: 191,353

[22] Filed: Sep. 26, 1980

[51] Int. Cl.[3] ..... B66C 17/08

[52] U.S. Cl. ..... 414/191; 212/210; 212/221; 212/270; 414/207; 414/786

[58] Field of Search ..... 212/205, 210, 216, 217, 212/221, 124, 125, 126, 127, 131, 142.1, 270, 206; 104/98; 105/163; 280/638; 414/191, 207, 786

[56] References Cited

U.S. PATENT DOCUMENTS

| | | | |
|---|---|---|---|
| 3,009,583 | 11/1961 | Pierson . | |
| 3,297,170 | 1/1967 | McCready | 212/210 |
| 3,458,229 | 7/1969 | Nagy et al. . | |
| 3,727,778 | 4/1973 | Hollenbach | 280/638 X |
| 3,784,028 | 1/1974 | Stewart | 105/163 X |
| 3,854,592 | 12/1974 | Mordre . | |
| 3,895,818 | 7/1975 | Fearon | 280/638 X |

*Primary Examiner*—Robert G. Sheridan

*Attorney, Agent, or Firm*—Maky, Renner, Otto & Boisselle

[57] ABSTRACT

A horizontally extendable trolley 22 comprising a trolley frame 51 and wheels 52 for supporting trolley frame 51, and a horizontally elongated trailer frame 54 slidably mounted on frame 51, said trailer frame 54 having a first end extending beyond an end of frame 51, and auxiliary wheels 56 for supporting said first end. Trolley 22 includes: means for horizontally extending trailer frame 54 outwardly from the trolley frame 51 and retracting trailer frame 54 inwardly toward trolley frame 51; hoisting means mounted on trolley frame 51; auxiliary hoisting means mounted on trailer frame 54; and means for driving wheels 52. Crane 10 for use with trolley 22 and methods for the use of cranes employing trolley 22 in steel making operations are disclosed.

40 Claims, 6 Drawing Figures

22
51
52a
52
54
56
72
74
76
78
80
82
84
86
88
90
92
94
96
98
104
106
108
110
116
118
120
122
124
128
130
132
134
136
138
140
142
144
146
148
150
152
154
156
158
160
162
164
166
168
170
172
174
176
178
180
182
184
186
188
190
192
194
196
198
200
202
204
206
208
210
212
240
242
246
248
252
256
258
260
261
12
14

EXTENDABLE CRANE TROLLEY AND METHOD

TECHNICAL FIELD

This invention relates generally to cranes, and in particular to trolleys mounted on cranes for transporting and pouring hot metal from hot metal transfer ladles and solid scrap steel from elongated scrap boxes. Specifically, the invention relates to a horizontally extendable crane trolley that is suitable for transporting and pouring hot metal from hot metal transfer ladles and solid scrap from elongated scrap boxes.

BACKGROUND OF THE INVENTION

In the production of steel, as for example, in the operation of a basic open hearth furnace, it is common practice to charge the furnace with a mixture of solid scrap steel and molten pig iron. For example, a mill which rolls its own steel ingots and has its own blast furnaces can effectively use this technique. The molten pig iron or hot metal is transported in and poured from hot metal transfer ladles. Present day transfer ladles generally have a circular or oval horizontal cross-section, and are fabricated from steel plate by riveting or welding and lined with refractory material. The ladle is lifted and tilted by an overhead crane to pour the hot metal, for example, into the mouth of a basic oxygen process steel making furnace. The ladle is lifted by a pair of ladle hooks that are suspended by the overhead crane and are pivotally hooked to a pair of diametrically opposed trunnions that project horizontally from the side of the ladle. The hot metal is poured into the furnace by tilting the ladle with an auxiliary crane hook attached to the rear of and near the bottom of the ladle. The auxiliary crane hook is also suspended by the overhead crane.

The solid scrap metal is transported to the furnace in a horizontally elongated metal scrap box. The scrap is produced from a number of sources. For example, scrap is produced in the pouring of molten metal into ingot molds; it consists of rejected ingots and ingots too short to roll; and scrap is produced when ingots and secondary products are rolled. In general, scrap is dumped into the furnace first, followed by the addition of hot metal. The scrap can be transported to the furnace by an overhead crane which includes an auxiliary crane hook attached to the back end of the scrap box for use in dumping the scrap.

In steel making operations wherein it is desirable to charge the furnace with both hot metal and solid metal scrap, it is preferred to transport both the hot metal ladle and the elongated scrap box with overhead cranes. Present day operations generally employ two different approaches to the design of such cranes. The first of these approaches is to use a four-girder bridge crane employing two trolleys. A larger trolley is mounted for overhead travel on the two outside girders and is adapted for carrying the hot metal ladle or functioning as the main hoist for the scrap box. A smaller trolley which operates underneath the larger trolley is mounted on the two inside girders and is adapted for carrying and tilting the back end of the elongated scrap box or tilting the hot metal ladle. The two trolleys can operate independently of each other with the smaller trolley passing under the larger trolley. An alternative approach to this design is to simply employ two cranes, one being adapted for transporting and pouring the hot metal ladle and the other being adapted for transporting and pouring the scrap box.

SUMMARY OF THE INVENTION

Cranes that employ horizontally extendable trolleys of the type shown in the drawings and hereinafter described can be used to transport and pour both hot metal ladles and horizontally elongated scrap boxes without the necessity of employing two trolleys or two separate cranes. Broadly stated, the invention contemplates a horizontally extendable trolley comprising frame means and wheel means for supporting said frame means, and a horizontally elongated trailer frame slidably mounted on said frame means, said trailer frame having a first end extending beyond an end of said frame means, and auxiliary wheel means for supporting said first end. Advantageously, the trolley of the present invention includes means for horizontally extending said trailer frame outwardly from said frame means and retracting said trailer frame inwardly toward said frame means, hoisting means mounted on said frame means, auxiliary hoisting means mounted on said trailer frame, and means for driving said wheel means for supporting said frame means. In a preferred embodiment the trailer frame comprises a pair of horizontally elongated parallel spaced frame members connected to each other by cross member means. In a particularly advantageous and, therefore, greatly preferred embodiment the cross member means of said trailer frame comprises a pair of horizontally elongated parallel spaced underslung beams fixedly attached to and disposed at right angles to said frame members, one of said beams being disposed at said first end of said trailer frame.

Further, the invention contemplates a crane for transporting and pouring hot metal ladles, elongated metal scrap boxes and the like, comprising a horizontally elongated bridge, means for supporting said bridge, a horizontally extendable trolley mounted on said bridge and adapted for horizontal travel along said bridge, said trolley including frame means, wheel means for supporting said frame means, and a horizontally elongated trailer frame slidably mounted on said frame means, said trailer frame having a first end extending beyond an end of said frame means, and auxiliary wheel means for supporting said first end.

Further the invention contemplates a steel making facility utilizing a crane for charging hot metal and scrap comprising a horizontally elongated bridge, means for supporting said bridge, and a horizontally extendable trolley mounted on said bridge and adapted for travel along said bridge, said trolley including a substantially rectangular trolley frame, wheel means for supporting said trolley frame, means for driving said wheel means, a horizontally elongated trailer frame slidably mounted on said trolley frame, said trailer frame having a first end extending beyond an end of said trolley frame and wheel means for supporting said first end, means for horizontally extending said trailer frame outwardly from said trolley frame and retracting said trailer frame inwardly toward said trolley frame, hoisting means mounted on said trolley frame, auxiliary hoisting means mounted on said trailer frame, a first plurality of ropefalls depending from said hoisting means, a second plurality of ropefalls depending from said auxiliary hoisting means, a ladle lifting beam suspended by said first plurality of ropefalls, said ladle lifting beam including a horizontally elongated member and a pair of parallel spaced ladle hooks depending from said elongated member, and an auxiliary hook suspended by said second plurality of ropefalls.

Further the invention contemplates a method for charging a furnace with hot metal and solid scrap comprising: providing a charging crane that includes a horizontally elongated bridge, means for supporting said bridge, means for horizontally moving said bridge, a horizontally extendable trolley mounted on said bridge and adapted for travel along said bridge, said trolley including a substantially rectangular trolley frame, wheel means for supporting said trolley frame, means for driving said wheel means, a horizontally elongated trailer frame slidably mounted on said trolley frame, said trailer frame having a first end extending beyond an end of said trolley frame and wheel means for supporting said first end, means for horizontally extending said trailer frame outwardly from said trolley frame and retracting said trailer frame inwardly toward said trolley frame, hoisting means mounted on said trolley frame, auxiliary hoisting means mounted on said trailer frame, a first plurality of ropefalls depending from said hoisting means, a second plurality of ropefalls depending from said auxiliary hoisting means, a ladle lifting beam suspended by said first plurality of ropefalls, said ladle lifting beam including a horizontally elongated member and a pair of parallel spaced ladle hooks depending from said elongated member, and an auxiliary hook suspended by said second plurality of ropefalls; positioning a scrap box containing solid scrap metal within the area serviced by said crane; extending said trailer frame outwardly from said trolley frame to permit said trolley to operate in its extended mode; moving said bridge and said trolley to position said trolley over said scrap box; lowering said ladle hooks and said auxiliary hook to attach said hooks to the trunnions of said scrap box; hoisting said scrap box, the long dimension of said scrap box being disposed substantially horizontally to avoid premature dumping of the contents of said scrap box; transporting said scrap box to a pouring point over the furnace to be serviced; raising said auxiliary hook to tilt said scrap box to cause the contents of said scrap box to empty into said furnace; transporting said scrap box away from said furnace depositing said scrap box at a desired point within the area serviced by said crane; retracting said trailer frame inwardly toward said trolley frame to permit said trolley to operate in its retracted mode; positioning a hot metal transfer ladle within the area serviced by said crane; moving said bridge and said trolley to position said trolley over said ladle; lowering said ladle hooks and said auxiliary hook to attach said hooks to the trunnions of said ladle; hoisting said ladle in an upright position to avoid premature dumping of the contents of said ladle; transporting said ladle to a pouring point over the furnace to be serviced; raising said auxiliary hook to tilt said ladle to cause the contents of said ladle to empty into said furnace; and transporting said ladle away from said furnace and depositing said ladle at a desired point within the area serviced by said crane.

DETAILED DESCRIPTION OF THE PREFERRED EMBODIMENT

Figure 1:
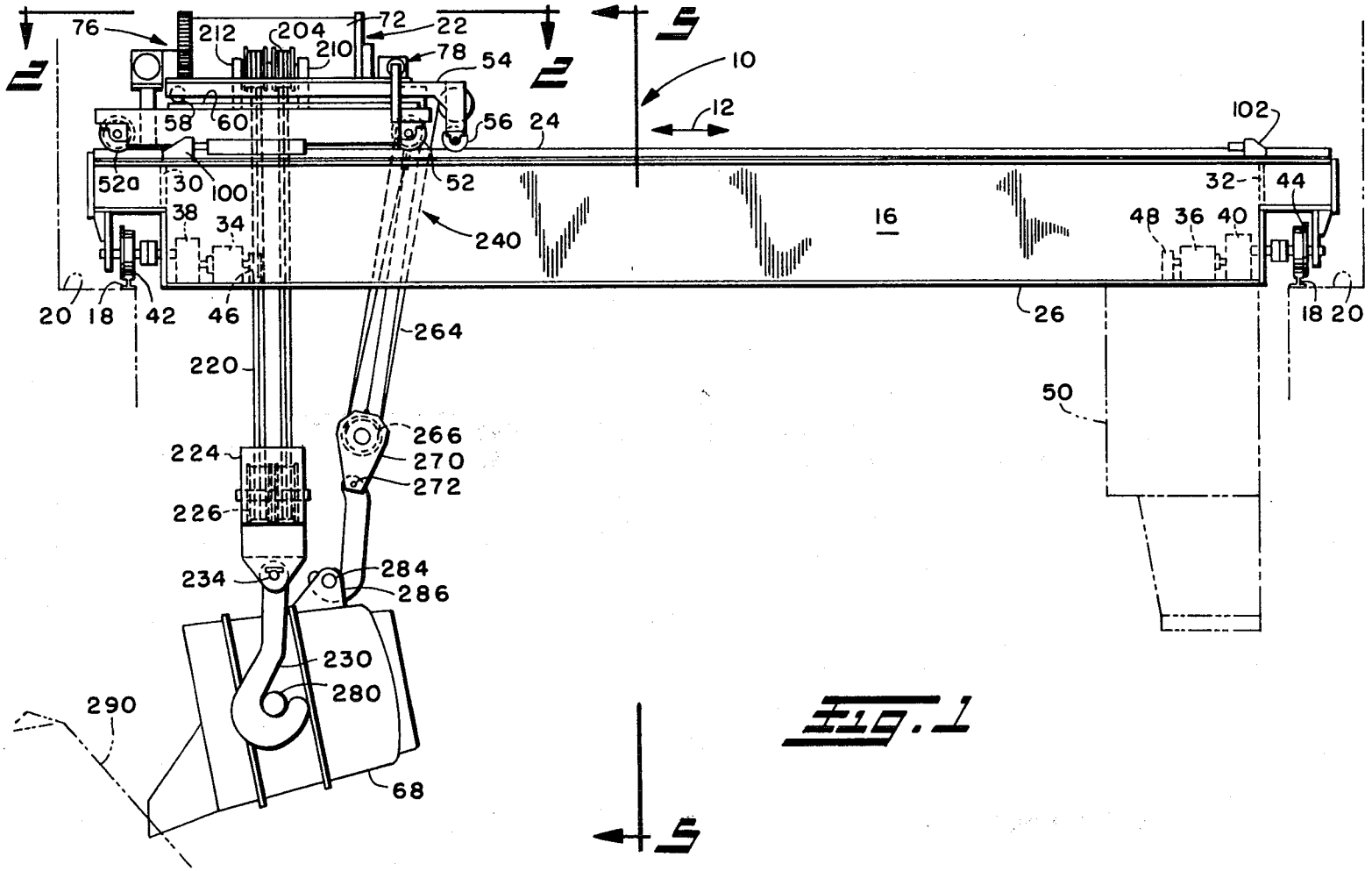
FIG. 1 is an elevational view of a crane embodying the present invention in a particular form, with the trolley of the present invention in a horizontally retracted mode adapted for transporting a hot metal ladle and pouring the contents thereof.

The crane of the present invention in its illustrated embodiment, as mounted, for example, for overhead travel, comprises (FIG. 1) an overhead traveling crane indicated generally by the reference numeral 10 which has provision for both longitudinal and transverse horizontal movements at right angles to one another, as indicated by directional arrows 12 and 14, so that the article being transported can be lifted and deposited or poured at any point within the rectangle covered by the movement of crane 10. Crane 10 comprises bridge 16 which is adapted for spanning, for example, the bay or floor of a steel mill, and moves transversely along horizontally elongated overhead parallel tracks 18 which are mounted on building structure 20; and a horizontally extendable trolley which is indicated generally by the reference numeral 22 and is adapted for longitudinal movement along tracks 24 which are mounted on bridge 16. It is to be understood, however, that any crane that is suitable for transporting articles such as hot metal transfer ladles and elongated scrap boxes and pouring the contents thereof can be used in combination with the horizontally extendable trolley of the present invention. Such cranes include, for example, rotating bridge cranes pinned at one end on a vertical axis with the other end mounted for rotational movement on circular or arcuate track. A gantry crane, which is similar in construction and design to overhead traveling crane 10 except that the overhead bridge is carried at each end by a vertically elongated trestle which travels along tracks mounted on the ground, can also be used in accordance with the present invention. In some instances an overhead crane supported at one end by an overhead track mounted, for example, on the side of a building structure and supported at the other end by a vertically elongated trestle traveling on tracks mounted on the ground, can also be used in accordance with the present invention.

Bridge 16 is a horizontally elongated rectangular frame comprising horizontally elongated parallel girders 26 and 28 connected by end-ties 30 and 32. Girders 26 and 28 are sufficiently elongated to traverse the ground or floor area to be serviced by crane 10. End-ties 30 and 32 are smaller than girders 26 and 28 but are sufficiently elongated to provide structural stability to crane 10 and to provide an open area between girders 26 and 28 to allow for the movement and operation of trolley 22. Bridge 16 preferably has a walkway or platform (not shown) to provide for the servicing, repair and oiling of the bridge and trolley. The movement of bridge 16 along tracks 18 is accomplished by the operation of electric motors 34 and 36 which are mounted on girder 26. Motors 34 and 36 rotatably engage gear reducers 38 and 40, which drive wheels 42 and 44, respectively. Gear reducers 38 and 40 are also mounted on girder 26. Electrically operated brakes 46 and 48 are mounted on girder 26 and aligned with motors 34 and 36, respectively, and are used to reduce or stop the rotation of the armatures of such motors. Wheels 42 and 44 each comprise a set of four wheels rotatably mounted for travel along tracks 18. In the illustrated embodiment, only one wheel of each set of wheels is actually driven, the others follow the driven wheel and provide the bridge with support. More wheels, for example eight wheels or fewer wheels, could be provided at each end of bridge 16 depending upon the anticipated loads to be handled by crane 10. The movements of bridge 16 as well as trolley 32 are activated and controlled from operator cage 50 which is bolted or welded to and depends from the bottom of girder 26 and comprises a central location for all the controls and switchboards necessary to activate and control each and every movement of the bridge and trolley.

Trolley 22 comprises a substantially rectangular frame 51 mounted on wheels 52 and adapted for longitudinal horizontal movement in the direction indicated by directional arrow 12 along tracks 24, and horizontally elongated trailer frame 54 which is slidably mounted on frame 51 and supported at one end by wheels 56 and at the other elongated end by wheels 58. Wheels 56 are adapted for travel along tracks 24. Wheels 58 are adapted for travel along horizontally elongated parallel tracks 60 which are mounted on frame 51 and extend horizontally in the direction indicated by directional arrow 12. Trolley 22 is adapted for operating in a retracted mode (FIG. 1) for transporting and pouring hot metal transfer ladle 68 and for operating in an extended mode (FIG. 6) for transporting and pouring elongated metal scrap box 70, all as hereinafter explained.

Trolley frame 51 is sufficiently elongated to span the opening between girders 26 and 28 and sufficiently elongated to support lifting barrels 72 and 74, the drive assembly indicated generally by the reference numeral 76 for rotating such barrels, the drive assembly indicated generally by the reference numeral 78 for extending and retracting trailer frame 54 and the drive assembly indicated generally by the reference numeral 80 for driving trolley 22 along tracks 24. Each of the girders 26 and 28 have one of the parallel tracks 24 mounted on it.

Figure 2:
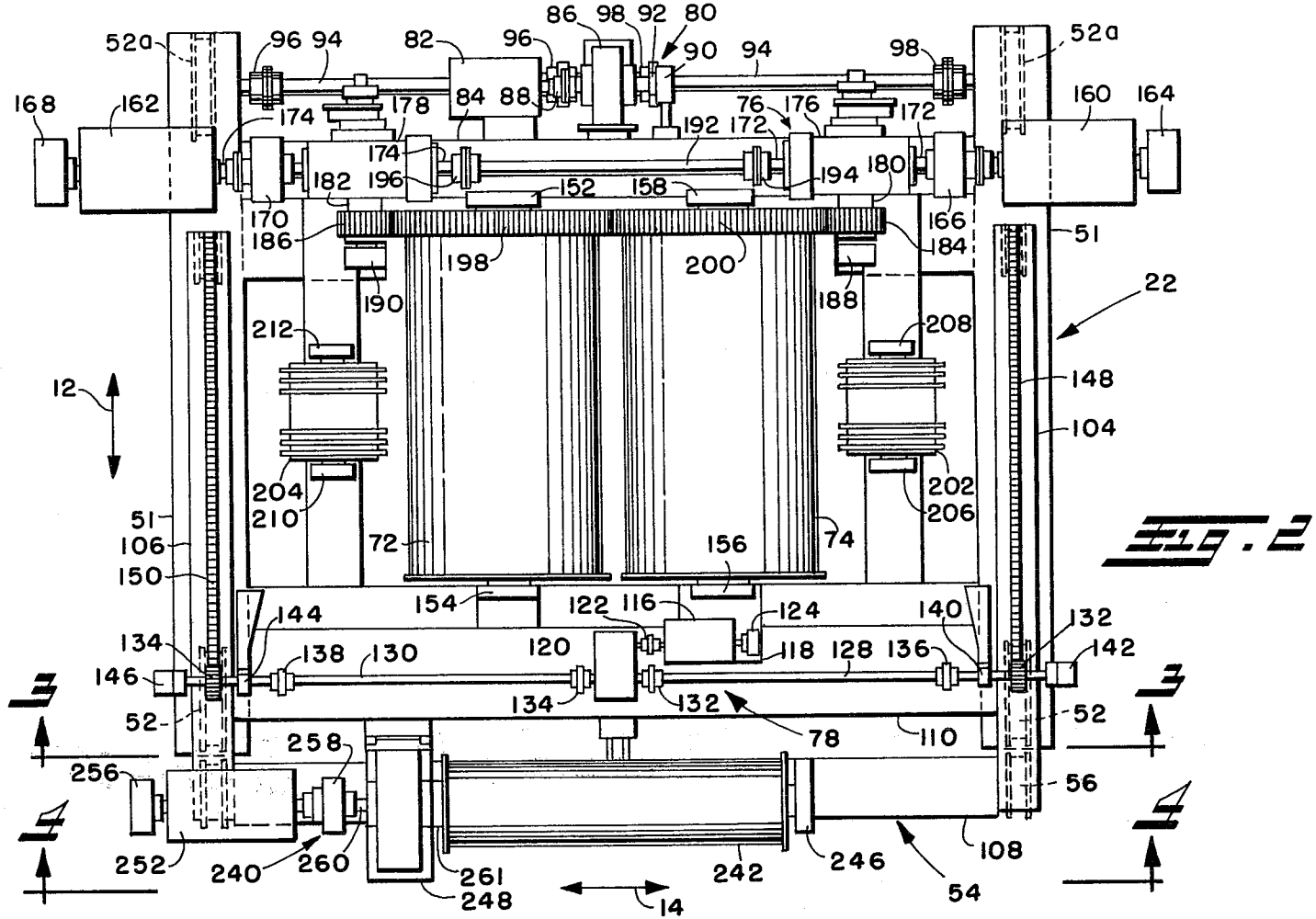
FIG. 2 is an enlarged top plan view of the crane in FIG. 1 taken along line 2—2 of FIG. 1, but rotated 90° in clockwise direction from line 2—2, illustrating a particular form of the trolley of the present invention.
Figure 6:
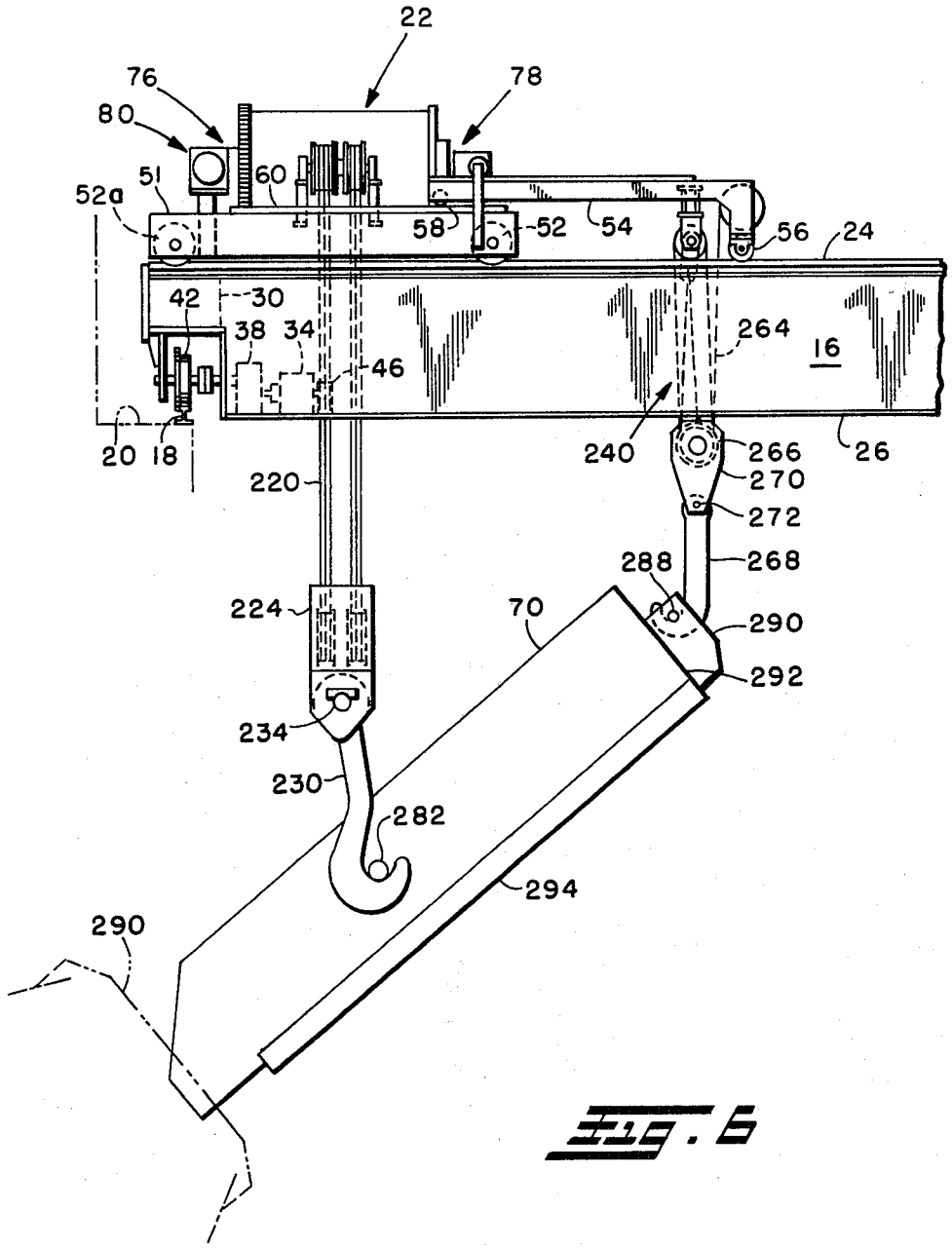
FIG. 6 is a partial elevational view of a crane embodying the present invention in a particular form similar to the view illustrated in FIG. 1, but illustrating the trolley in a horizontally extended mode adapted for transporting a horizontally elongated scrap box and pouring the contents thereof.

Trolley 22 is driven along tracks 24 by trolley drive assembly 80 which comprises (FIG. 2) electric motor 82 which is mounted on frame member 84 of frame 51 and is rotatably attached to gear reducer 86 by coupling 88. Gear reducer 86 and electrically operated brake 90 are also mounted on frame member 84. Brake 90 engages shaft 92 which projects from gear reducer 86. Motor 82, coupling 88, the upper portion of gear reducer 86, shaft 92 and brake 90 are horizontally disposed on a centerline above drive shaft 94. Gear reducer 86 projects vertically downwardly. Drive shaft 94 is horizontally disposed below motor 82 and rotatably engages gear reducer 86. Mounted on the ends of drive shaft 94 are wheels 52*a*. Drive shaft 94 is rotatably attached to couplings 96 and 98. Motor 82 and brake 90 are activated and controlled from operator cage 50. The rotation of the armature of motor 82 transmits rotational motion to gear reducer 86 which in turn causes drive shaft 94 to rotate and drive wheels 52*a*. The rotation of the armature in one direction drives trolley 22 from left to right along bridge 16 as illustrated in FIGS. 1 or 6, the rotation of the armature in the opposite direction drives the trolley from right to left. The movement of trolley 22 is slowed or stopped by the activation of brake 90. The movement of trolley 22 beyond the edges of bridge 16 is prevented by bumper stops 100 and 102 which are bolted or welded to girders 26 and 28.

Figure 3:
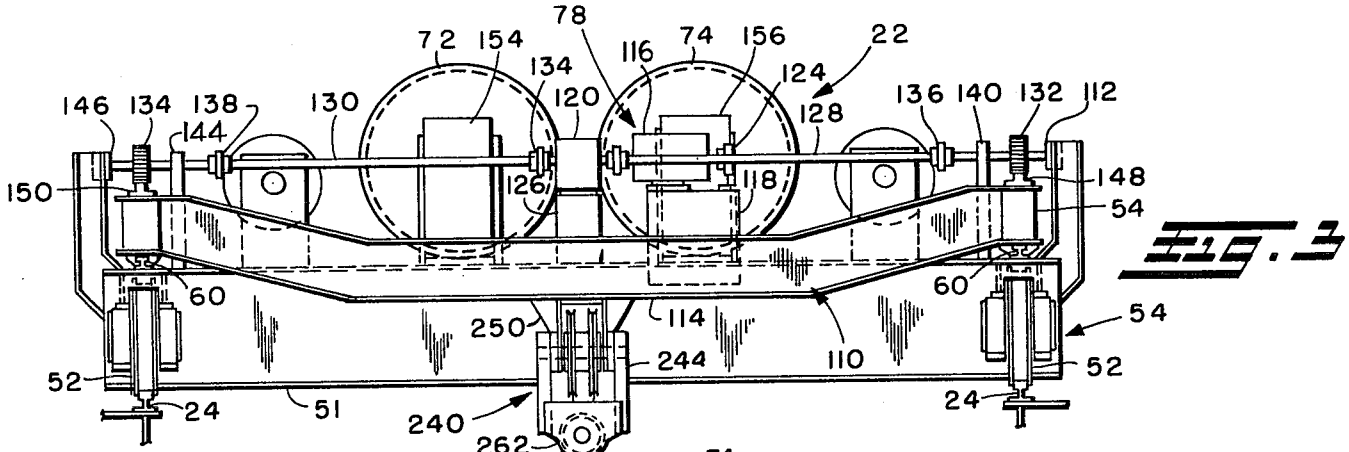
FIG. 3 is a side elevational view of the trolley of FIG. 2 taken along line 3—3 of FIG. 2.
Figure 4:
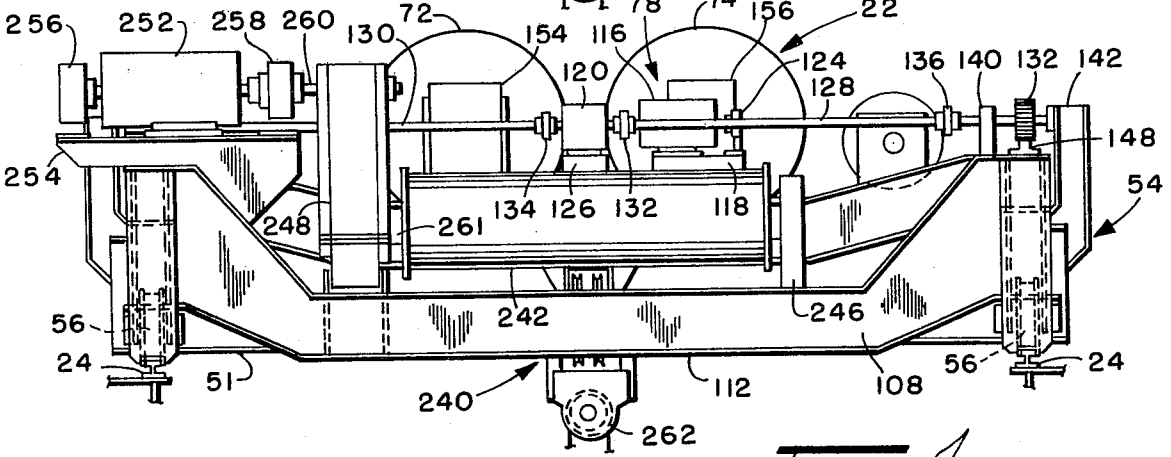
FIG. 4 is a side elevational view of the trolley of FIG. 2 taken along line 4—4 of FIG. 2.

Trailer frame 54 (FIGS. 2 to 4) has a pair of horizontally elongated, parallel spaced frame members 104 and 106 that extend in the direction indicated by directional arrow 12 and are supported on the top of frame 51 by wheels 58. Wheels 58 are rotatably attached to members 104 and 106 and are adapted for travel along tracks 60. Frame members 104 and 106 are connected to each other by underslung beams 108 and 110. Beams 108 and 110 are spaced parallel to each other and are welded to frame members 104 and 106. Beams 108 and 110 project initially inwardly from frame members 104 and 106 at downward sloping angles to underslung horizontally disposed center portions 112 and 114, respectively. Center portions 112 and 114 are spaced parallel to each other. Center portion 112 is disposed in a lower horizontal plane than center portion 114.

The sliding movement of trailer frame 54 is accomplished by the activation and control of drive assembly 78. Drive assembly 78 comprises electric motor 116 which is mounted on support member 118 which is welded to and projects upwardly from frame 51. Motor 116 is rotatably attached to gear reducer 120 by coupling 122. Motor 116 is also rotatably attached to electric brake 124 which is mounted on support member 118. Gear reducer 120 is mounted on support member 126 which is welded to and projects upwardly of frame 51. Drive shafts 128 and 130 project horizontally outwardly from gear reducer 120 and are attached to gear reducer 120 by couplings 131 and 133, respectively. Drive shafts 128 and 130 are disposed in parallel spaced relationship to the centerline of motor 116. Pinion gears 132 and 134 are attached to drive shafts 128 and 130 by couplings 136 and 138, respectively. Pinion gears 132 and 134 are supported by pillow blocks 140 and 142, and 144 and 146, respectively, which contain bearing assemblies to permit the rotational movement of gears 132 and 134. Pillow blocks 140,142, 144 and 146 are bolted to and project upwardly of frame 51. Pinion gears 132 and 134 are aligned with and rotatably engage horizontally elongated rack gears 148 and 150, respectively. Rack gears 148 and 150 are mounted on and extend horizontally along the upper surface of frame members 104 and 106, respectively, of frame 54. The rotation of the armature of motor 116 transmits rotational movement to gear reducer 120 which in turn induces the rotation of drive shafts 128 and 130 resulting in the rotation of pinion gears 132 and 134. The rotation of the armature in one direction causes the pinion gears to rotate in clockwise direction, while the rotation of the armature in the opposite direction causes the pinion gears to rotate in counterclockwise direction. The rotation of pinion gears 132 and 134 results in a retracting movement of frame 54 toward frame 51 or an extending movement of frame 54 away from frame 51. The rotational movement of gears 132 and 134 is reduced or stopped by the activation of brake mechanism 124. When frame 54 is extended for operation in the mode illustrated in FIG. 6 or retracted for operation in the mode illustrated in FIG. 1, it is locked in place by the locking of brake mechanism 124. The inward and outward movement of frame 54 is limited by mechanical stops, and limit switches (not shown) which deactivate motor 116 when frame 54 reaches a predetermined inward or outward position.

Lifting barrels 72 and 74 (FIG. 2) are rotatably mounted on pillow blocks 152 and 154, and 156 and 158, respectively, which are bolted to and project upwardly from frame 51. The center axes of barrels 72 and 74 are disposed parallel to each other in spaced relationship. Barrels 72 and 74 are rotated by drive assembly 76. Drive assembly 76 comprises electric motors 160 and 162 which are mounted on frame 51. Motors 160 and 162 are connected to electrically operated brake mechanisms 164 and 166, and 168 and 170, respectively. Each brake mechanism 164, 166, 168 and 170 is mounted on frame 51 and is designed to reduce or stop the rotation of barrels 72 and 74 and, optionally, lock the barrels in place during the transport of craneloads. Each motor 160 and 162 employs two brakes to provide an added measure of safety. Thus, while one brake on each motor is adequate under various advantageous conditions, two are preferred, particularly when ladles of hot metal are being transported. Shafts 172 and 174 are rotated by motors 160 and 162, project horizontally from brakes 166 and 170, and rotatably engage worm reducers 176 and 178, respectively. Drive shafts 180 and 182 project from worm reducers 176 and 178, respectively, at right angles to the center line of line shafts 172 and 174 and are connected to pinion gears 184 and 186. Drive shafts 180 and 182 are rotatably supported by bearings 188 and 190, respectively, which are mounted on frame 51. Shafts 172 and 174 project from worm reducers 176 and 178 and are connected to line shaft 192 by couplings 194 and 196. The connection at line shaft 192 mechanically synchronizes motors 160 and 162 to insure that the rates of rotation of such motors are equal. Pinion gears 184 and 186 rotatably engage gears 198 and 200 which are mounted on the ends of barrels 72 and 74, respectively. Gears 198 and 200 are operated with zero backlash, respectively, the rotation of gears 198 and 200 being timed so that the gear teeth of one does not touch the gear teeth of the other during normal operation. In the event, however, that one or more components in the drive assembly of either barrel 72 or 74 should fail, the gear teeth of gears 198 and 200 would engage each other so that the functioning drive assembly would drive both barrels 72 and 74 to prevent an unbalancing of the load being carried by the crane. Barrel 72 rotates in a clockwise direction when barrel 74 rotates in counterclockwise direction, and vice versa. Upper sheaves 202 and 204 are rotatably mounted on bearing blocks 206 and 208, and 210 and 212, respectively, with their axes of rotation spaced parallel to the axes of rotation of barrels 72 and 74. Bearing blocks 206, 208, 210 and 212 are welded to and project upwardly from frame 51.

Figure 5:
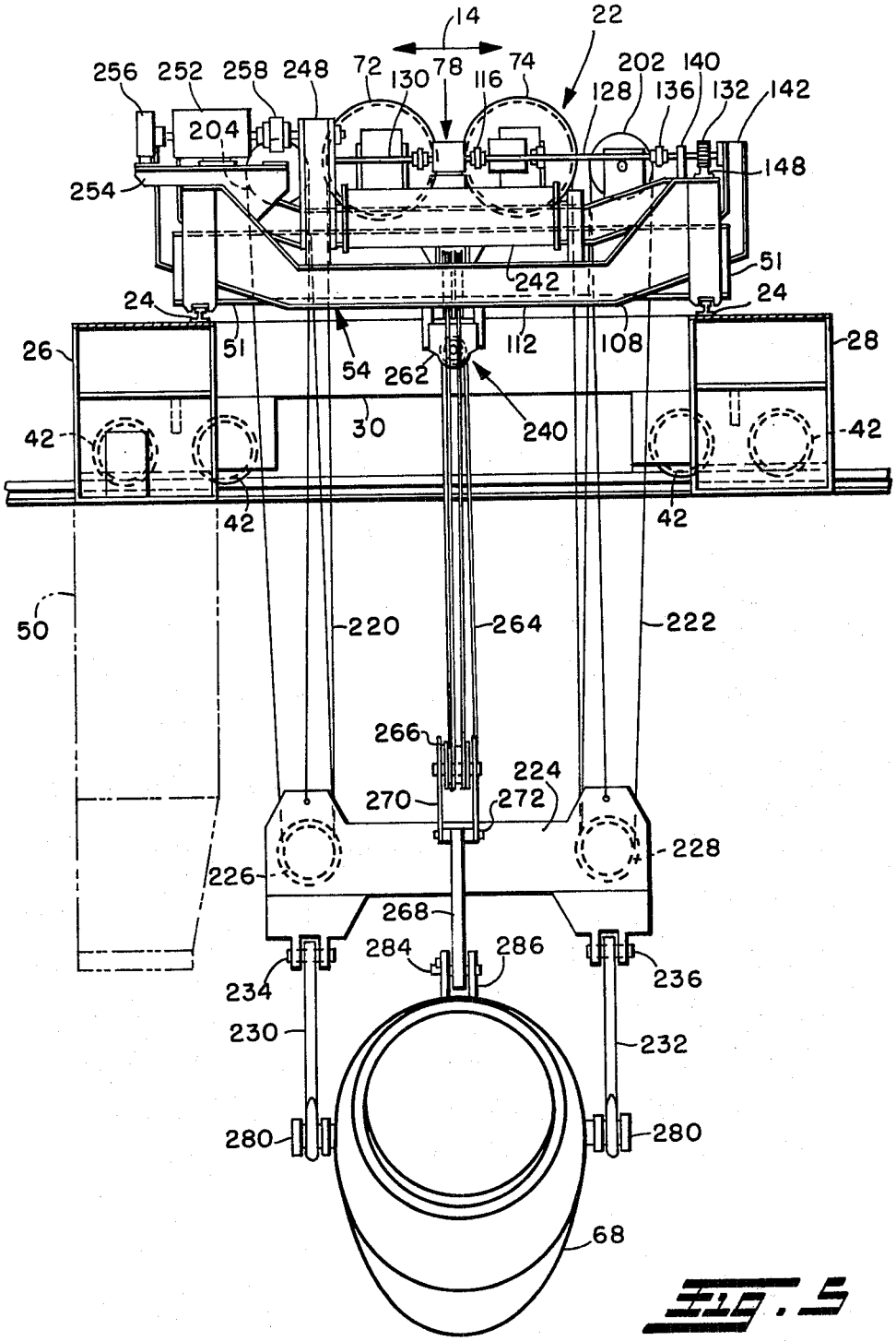
FIG. 5 is a side elevational view of the crane of FIG. 1 taken along line 5—5 of FIG. 1.

Depending from barrel 72 and upper sheave 204 are ropefalls 220 (FIG. 5). Likewise, depending from barrel 74 and upper sheave 202 are ropefalls 222. Ropefalls 220 and 222 are disposed between girders 26 and 28. Suspended by ropefalls 220 and 222 is lifting beam 224. The ropefalls, lifting barrels and upper sheaves are arranged so that the load hoisted and carried by trolley 22 is centrally distributed evenly over girders 26 and 28. Each ropefall 220 and 222 preferably comrises fourteen wire ropes, seven of the ropes being coiled in right-handed grooves in each of the barrels 72 and 74, respectively, and the other seven being coiled in lefthanded grooves in each of the respective barrels. Additional wire ropes or fewer wire ropes can be utilized with each ropefall, the number and design of such ropes being dependent upon the anticipated loads to be hoisted. Rotatably attached to lifting beam 224 are hoisting sheaves 226 and 228 which are attached to ropefalls 220 and 222, respectively. Depending from lifting beam 224 are ladle hooks 230 and 232 which are pivotally attached to lifting beam 224 by pins 234 and 236, respectively. Ropes 220 drop from barrel 72 to hoisting sheave 226, wrap around sheave 226, extend upwardly to sheave 204, continue for the necessary number of falls and ultimately return to beam 224 where they dead end. Similarly, ropes 222 drop from barrel 74 to hoisting sheave 228, wrap around sheave 228, extend upwardly to sheave 202, wrap around sheave 202, continue for the necessary number of falls and ultimately return to beam 224 where they dead end. The dead ends of ropes 220 and 222 are attached to lifting beam 224 with an equalizer bar (not shown). The winding or unwinding of ropes 220 and 222 on barrels 72 and 74, respectively, result in a consequent shortening or lengthening of rope falls 220 and 222 to lift or lower lifting beam 224.

An auxiliary hoist which is indicated generally by the reference 240 and mounted on trailer frame 54 comprises (FIGS. 2 to 5) auxiliary lifting barrel 242 and auxiliary upper sheave 244. Lifting barrel 242 is rotatably supported by pillow block 246 and gear reducer 248. Pillow block 246 is bolted to and projects upwardly from underslung beam 108. Pillow block 246 contains a bearing assembly that permits barrel 242 to rotate. Gear reducer 248 is mounted on and projects upwardly from beam 108. Upper sheave 244 is rotatably mounted on bracket 250 which depends from and is welded to the bottom of underslung beam 110. The center axes of barrel 242 and sheave 244 are spaced parallel to each other with the center axis of sheave 244 being disposed in a lower plane than the center axis of barrel 242. Barrel 242 is driven by electric motor 252. Motor 252 is mounted on support member 254 which is welded to the top of beam 108. Motor 252 is connected to electrically operated brake mechanisms 256 and 258. Brake 256 is mounted on support member 254 in the rear of motor 252 and engages the armature of motor 252. Brake 258 is mounted on support member 254 in front of motor 252 and also engages the armature of motor 252. Brakes 256 and 258 are disposed on a center line with motor 252. Brakes 256 and 258 are employed to reduce or to stop the rotation of barrel 242 and, optionally, lock the barrel in place during the transport of crane loads. Two brakes are provided as an added measure of safety. Thus, while one brake is adequate under various advantageous conditions, two are preferred, particularly when elongated scrap boxes are transported with their long dimension disposed horizontally, as hereinafter described. Shaft 260 projects from gear reducer 248 and engages brake 258. Gear reducer 248 engages drive shaft 261 which is attached to barrel 242. The rotation of the armature of motor 252 transmits rotational movement to gear reducer 248 which in turn causes barrel 242 to rotate. Rotatably attached to the housing of upper sheave 244 is equalizer sheave 262. Depending from drum 242, upper sheave 244 and equalizer sheave 262 are ropefalls 264 which suspend hoisting sheave 266 which is rotatably mounted in housing 270. (FIGS. 1, 5, and 6). Auxiliary hook 268 is pivotally attached to housing 270 by pin 272 and depends from housing 270. Ropefall 264 preferably comprises eight wire ropes. Four of the ropes are coiled in right-handed grooves in barrel 242 and the other four are coiled in the left-handed grooves in barrel 242. Additional wire ropes or fewer wire ropes can be utilized with ropefall 264, the number and design of such wire ropes being dependent upon the anticipated loads to be hoisted. Ropes 264 project from drum 242, drop to sheave 266, wrap around sheave 266, extend upwardly to sheave 244, wrap around sheave 244, drop to sheave 266, wrap around sheave 266, extend upwardly up to equalizer sheave 262 and return to sheave 266 and continue for the necessary number of falls. Both ends of rope 264 dead end on lifting barrel 242. Equalizer sheave 262 provides for equalized reeving. The rotation of lifting barrel 242 results in a consequent shortening or lengthening of rope falls 264 to lift or lower auxiliary hook 268.

Hot metal transfer ladle 68 (FIGS. 1 and 5) is suitable for transporting and pouring hot metal in any conventional steel making operation. Similarly, horizontally elongated scrap box 70 (FIG. 6) is suitable for transporting and pouring solid scrap steel in any conventional steel making operation. Ladle 68 and scrap box 70 are entirely conventional in design and construction and, being well known to those skilled in the art, need not be further described herein. Ladle 68 has a pair of diametrically opposed horizontally projecting trunnions 280 pivotally attached to the sides of ladle 68. Trunnions 280 are adapted for attachment to ladle hooks 230 and 232. Ladle hooks 230 and 232 are horizontally spaced a sufficient distance to accommodate trunnions 280. Similarly, scrap box 70 has a pair of horizontally projecting trunnions 282 attached to its sides. Trunnions 282 are adapted for attachment to ladle hooks 230 and 232. Auxiliary trunnion 284 is mounted on bracket 286 which is welded to and projects outwardly from the lower portion of ladle 68. Auxiliary trunnion 284 is evenly spaced between trunnions 280 and is adapted for attachment to auxiliary hook 268. Auxiliary trunnion 288 is mounted on bracket 290 which is welded to and projects outwardly from back end 292 of scrap box 70. Trunnion 288 is centrally located on back end 292 and is adapted for attachment to hook 268.

Trolley 22 is operated in its retracted mode (FIG. 1) when it is used for transporting and pouring ladle 68. In operation bridge 16 moves along tracks 18 and trolley 22 moves along tracks 24 until ladle hooks 230 and 232 and auxiliary hook 268 are suspended over ladle 68. Ladle hooks 230 and 232 are then lowered by the activation of drive assembly 76 to rotate barrels 72 and 74 until ladle hooks 230 and 232 are in sufficiently close proximity to trunnions 280 for attachment. Ladle 68 which is standing upright is filled with, for example, hot metal. Auxiliary hook 268 is lowered by the rotation of barrel 242 until hook 268 is in sufficiently close proximity to trunnion 284 for attachment. Hooks 230 and 232 are attached to trunnions 280 and hook 268 is attached to trunnion 284. Ladle 68 is hoisted by the rotation of barrels 72 and 74 which moves hooks 230 and 232 upwardly. Barrel 242 is also rotated to raise hook 268. Ladle 68 is transported in its upright position with hook 268 attached to trunnion 284, but not exerting significant hoisting force on trunnion 284. With the upward hoisting of ladle 68 bridge 16 is moved along tracks 18 and trolley 22 is moved along tracks 24 until ladle 68 is suspended over its point of destination. Upon reaching the point of destination which may be, for example, over the mouth of a basic oxygen process steel making furnace 290, ladle 68 is lowered by the rotation of barrels 72 and 74 until it is close enough to the mouth of furnace 290 for pouring. Hook 268 is also lowered by the rotation of barrel 242. Upon reaching the pouring point the rotation of barrels 72 and 74 is stopped to hold ladle 68 in a stationary position and the rotation of barrel 242 is started to lift hook 268 upwardly to tilt ladle 68 to the position illustrated in FIG. 1. The tilting of ladle 68 causes the contents thereof to be poured into furnace 290. Upon completion of the pouring process ladle 68 is hoisted by the upward movement of hooks 230 and 232 and hook 268, and transported by the horizontal movements of bridge 16 and trolley 22 away from furnace 290 to a desired destination within the rectangle covered by crane 10. Upon reaching its destination, ladle 68 is placed down by the lowering of hooks 230 and 232 and hook 268. Upon being placed down hooks 230 and 232 and hook 268 are disconnected.

The transporting and pouring of the scrap box 70 is accomplished with trolley 22 adjusted to operate in the extended mode illustrated in FIG. 6. Trolley 22 is adjusted to operate in its extended mode by the activation of drive assembly 78 which slides trailer frame 54 outwardly from the position illustrated in FIG. 1 to the position illustrated in FIG. 6. Bridge 16 moves along tracks 18 and trolley 22 moves along tracks 24 until hooks 230 and 232 and hook 268 are suspended over scrap box 70. Scrap box 70 contains solid scrap metal and rests on the ground or floor level on its bottom side 294 with the long dimension of scrap box 70 extending horizontally. Hooks 230 and 232 are lowered by the activation of drive assembly 76 to rotate barrels 72 and 74 until hooks 230 and 232 are in sufficiently close proximity to trunnions 282 for attachment to trunnions 282. Hook 268 is lowered by the rotation of barrel 242 until hook 268 is in sufficiently close proximity to trunnion 288 for attachment. Hooks 230 and 232 are then attached to trunnions 282 and hook 268 is attached to trunnion 288. Scrap box 70 is hoisted and transported with its bottom side 294 kept substantially horizontal to avoid premature dumping of the contents of scrap box 70. Hooks 230 and 232 and hook 268 are hoisted at substantially even lifting rates. Bridge 16 is moved along tracks 18 and trolley 22 is moved along tracks 24 until scrap box 70 is suspended over its place of destination which can be, for example, furnace 290. Scrap box 70 is then lowered to a position for pouring its contents into furnace 290 by the lowering of hooks 230 and 232 and hook 268. Upon reaching the position for pouring, barrel 242 is rotated to lift hook 268 which causes back end 292 of scrap box 70 to move upwardly, causing scrap box 70 to tilt, as illustrated in FIG. 6, and empty the contents of scrap box 70 into furnace 290. When the contents of scrap box 70 have been emptied, scrap box 70 is hoisted upwardly by the upward movement of hooks 230 and 232 and hook 268. Bridge 16 is moved along tracks 18 and trolley 22 is moved along tracks 24 to transport the empty scrap box to a desired point of destination within the rectangle serviced by crane 10. Upon reaching its destination scrap box 70 is lowered by the downward movement of hooks 230 and 232 and hook 268 until scrap box 70 is placed down. Upon being placed down the hooks 230 and 232 and hook 268 are disconnected.

An advantage of employing the horizontally extendable trolley disclosed herein is that both hot metal ladles and elongated scrap boxes can be transported with a single trolley and, consequently, a single crane. The disadvantages of using a four girder crane employing two separate trolleys, or two separate cranes are thus avoided.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A horizontally extendable trolley suitable for transporting hot metal ladles and the like when operating in a retracted mode and elongated scrap boxes and the like when operating in an extended mode comprising frame means and wheel means for supporting said frame means, hoisting means mounted on said frame means, means for driving said wheel means for supporting said frame means, and a horizontally elongated trailer frame slidably mounted on said frame means, said trailer frame having a first end extending beyond an end of said frame means, auxiliary wheel means for supporting said first end, auxiliary hoisting means mounted on said trailer frame, means for horizontally extending said trailer frame outwardly from said frame means and retracting said trailer frame inwardly toward said frame means, said trailer frame being supported by movable means adapted for travel on first track means mounted on said frame means, and said wheel means for supporting said frame means and said auxiliary wheel means being adapted for travel along a second track means.

2. The trolley of claim 1 wherein said frame means comprises a horizontally elongated rectangular frame.

3. The trolley of claim 1 wherein said trailer frame comprises a pair of horizontally elongated parallel spaced frame members connected to each other by cross member means.

4. The trolley of claim 3 wherein said cross member means comprises a pair of horizontally elongated parallel spaced underslung beams fixedly attached to and disposed at right angles to said frame members, one of said beams being disposed at said first end of said trailer frame.

5. The trolley of claim 1 wherein said wheel means for supporting said frame means comprises a plurality of wheels rotatably attached to said frame means and adapted for travel along said second track means.

6. The trolley of claim 5 wherein said auxiliary wheel means comprises a plurality of wheels rotatably attached to said trailer frame and adapted for travel along said second track means.

7. The trolley of claim 1 wherein said means for extending and retracting said trailer frame comprises a horizontally elongated rack gear mounted on said trailer frame and a pinion gear supported by said frame means, said pinion gear being adapted for engaging said rack gear, and means for rotating said pinion gear.

8. The trolley of claim 1 wherein said hoisting means comprises a pair of lifting barrels and a pair of upper sheaves rotatably mounted on said frame means, said lifting barrels being horizontally aligned in spaced parallel relationship to said upper sheaves, and means for rotating said lifting barrels.

9. The trolley of claim 1 wherein said auxiliary hoisting means comprises an auxiliary lifting barrel and an auxiliary upper sheave rotatably mounted on said trailer frame, said auxiliary lifting barrel being horizontally aligned in spaced parallel relationship to said auxiliary upper sheave, and means for rotating said auxiliary lifting barrel.

10. The trolley of claim 1 wherein said wheel means comprises a plurality of wheels rotatably attached to said frame means and said means for driving said wheel means comprises an electric motor and a gear reducer rotatably connected to each other and mounted on said frame means, and a drive shaft rotatably attached to said gear reducer, at least one of said wheels being connected to said drive shaft.

11. A crane for transporting and pouring hot metal ladles, elongated scrap boxes and the like comprising a horizontally elongated bridge, means for supporting said bridge, a horizontally extendable trolley mounted on said bridge and adapted for horizontal travel along said bridge, said trolley including frame means, wheel means for supporting said frame means, hoisting means mounted on said frame means, means for driving said wheel means for supporting said frame means, and a horizontally elongated trailer frame slidably mounted on said frame means, said trailer frame having a first end extending beyond an end of said frame means, auxiliary wheel means for supporting said first end, auxiliary hoisting means mounted on said trailer frame, means for horizontally extending said trailer frame outwardly from said frame means and retracting said trailer frame inwardly toward said frame means, said trailer frame being supported by movable means that is adapted for travel on a first track means mounted on said frame means, and said wheel means for supporting said frame means and said auxiliary wheel means being adapted for travel along a second track means mounted on said bridge.

12. The crane of claim 11 wherein said frame means comprises a horizontally elongated rectangular frame.

13. The crane of claim 11 wherein said trailer frame comprises a pair of horizontally elongated parallel spaced frame members connected to each other by cross member means.

14. The crane of claim 13 wherein said cross member means comprises a pair of horizontally elongated parallel spaced underslung beams fixedly attached to and disposed at right angles to said frame members, one of said beams being disposed at said first end of said trailer frame.

15. The crane of claim 11 wherein said means for extending and retracting said trailer frame comprises a horizontally elongated rack gear mounted on said trailer frame and a pinion gear supported by said frame means, said pinion gear being adapted for engaging said rack gear, and means for rotating said pinion gear.

16. The crane of claim 11 wherein said hoisting means comprises a pair of lifting barrels and a pair of upper sheaves rotatably mounted on said frame means, said lifting barrels being horizontally aligned in spaced parallel relationship to said upper sheaves, and means for rotating said lifting barrels.

17. The crane of claim 11 wherein said auxiliary hoisting means comprises an auxiliary lifting barrel and an auxiliary upper sheave rotatably mounted on said trailer frame, said auxiliary lifting barrel being horizontally aligned in spaced parallel relationship to said auxiliary upper sheave, and means for rotating said auxiliary lifting barrel.

18. The crane of claim 11 with a first plurality of ropefalls depending from said hoisting means.

19. The crane of claim 12 with a ladle lifting beam suspended by said first plurality of ropefalls.

20. The crane of claim 19 wherein said ladle lifting beam comprises a horizontally elongated member suspended by said ropefalls and a pair of parallel spaced ladle hooks depending from said elongated member.

21. The crane of claim 11 with a second plurality of ropefalls depending from said auxiliary hoisting means.

22. The crane of claim 21 with an auxiliary hook suspended by said second plurality of ropefalls.

23. The crane of claim 11 wherein said means for supporting said bridge comprises a pair of horizontally elongated tracks mounted on the ground and said bridge is mounted on vertically elongated trestles that are mounted for travel along said tracks.

24. The crane of claim 11 wherein said means for supporting said bridge comprises a pair of horizontally elongated parallel spaced tracks mounted overhead.

25. The crane of claim 11 wherein said means for supporting said bridge comprises an arcuate track mounted on the ground or overhead.

26. The crane of claim 11 with an operator cage depending from said bridge.

27. The crane of claim 11 wherein said bridge comprises a horizontally elongated rectangular frame comprising a pair of horizontally elongated girders connected by end-ties, said girders being sufficiently elongated to traverse the ground or floor area being serviced by said crane, said end-ties being sufficiently elongated to provide said bridge with structural stability and to provide a sufficiently open area between said girders to allow for the movement and operation of said trolley.

28. The crane of claim 11 wherein said trolley is adapted for transporting and pouring hot metal ladles when said trolley is operated in a retracted mode.

29. The crane of claim 11 wherein said trolley is adapted for transporting and pouring elongated scrap boxes when said trolley is operated in an extended mode.

30. In a steel making facility a crane for charging hot metal and scrap comprising a horizontally elongated bridge, means for supporting said bridge, and a horizontally extendable trolley mounted on said bridge and adapted for travel along said bridge, said trolley including a substantially rectangular trolley frame, wheel means for supporting said trolley frame, means for driving said wheel means, a horizontally elongated trailer frame, slidably mounted on said trolley frame, said trailer frame having a first end extending beyond an end of said trolley frame and wheel means for supporting said first end, means for horizontally extending said trailer frame outwardly from said trolley frame and retracting said trailer frame inwardly toward said trolley frame, hoisting means mounted on said trolley frame, auxiliary hoisting means mounted on said trailer frame, a first plurality of ropefalls depending from said hoisting means a second plurality of ropefalls depending from said auxiliary hoisting means, a ladle lifting beam suspended by said first plurality of ropefalls, said ladle lifting beam including a horizontally elongated member and a pair of parallel spaced ladle hooks depending from said elongated member, and an auxiliary hook suspended by said second plurality of ropefalls.

31. The crane of claim 30 wherein said trailer frame is mounted on wheels that are adapted for travel on a first pair of horizontally elongated parallel spaced tracks mounted on said trolley frame.

32. The crane of claim 30 wherein said trailer frame comprises a pair of horizontally elongated parallel spaced frame members connected to each other by cross member means.

33. The crane of claim 32 wherein said cross member means comprises a pair of horizontally elongated parallel spaced underslung beams fixedly attached to and disposed at right angles to said frame members, one of said beams being disposed at said first end of said trailer frame.

34. The crane of claim 30 wherein said wheel means for supporting said trolley frame comprises a plurality of wheels rotatably attached to said trolley frame and adapted for travel along a second pair of horizontally elongated parallel spaced tracks mounted on said bridge.

35. The crane of claim 34 wherein said wheel means for supporting said first end of said trailer frame comprises a plurality of wheels rotatably attached to said trailer frame and adapted for travel along said second pair of tracks.

36. The crane of claim 30 wherein said means for extending and retracting said trailer frame comprises a horizontally elongated rack gear mounted on said trailer frame and a pinion gear supported by said trolley frame, said pinion gear being adapted for engaging said rack gear, and means for rotating said pinion gear.

37. The crane of claim 30 wherein said hoisting means comprises a pair of lifting barrels and a pair of upper sheaves rotatably mounted on said trolley frame, said lifting barrels being horizontally disposed in spaced parallel relationship to said upper sheaves, and means for rotating said lifting barrels.

38. The crane of claim 30 wherein said auxiliary hoisting means comprises an auxiliary lifting barrel and an auxiliary upper sheave rotatably mounted on said trailer frame, said auxiliary lifting barrel being horizontally disposed in spaced parallel relationship to said auxiliary upper sheave, and means for rotating said auxiliary lifting barrel.

39. The crane of claim 30 wherein said wheel means comprises a plurality of wheels rotatably attached to said trolley frame and said means for driving said wheel means comprises an electric motor and a gear reducer rotatably connected to each other and mounted on said trolley frame, and a drive shaft rotatably attached to said gear reducer, at least one of said wheels being connected to said drive shaft.

40. A method for charging a furnace with hot metal and solid scrap comprising (a) providing a charging crane that includes a horizontally elongated bridge, means for suporting said bridge, means for horizontally moving said bridge, a horizontally extendable trolley mounted on said bridge and adapted for travel along said bridge, said trolley including a substantially rectangular trolley frame, wheel means for supporting said trolley frame, means for driving said wheel means, a horizontally elongated trailer frame slidably mounted on said trolley frame, said trailer frame having a first end extending beyond an end of said trolley frame and wheel means for supporting said first end, means for horizontally extending said trailer frame outwardly from said trolley frame and retracting said trailer frame inwardly toward said trolley frame, hoisting means mounted on said trolley frame, auxiliary hoisting means mounted on said trailer frame, a first plurality of ropefalls depending from said hoisting means, a second plurality of ropefalls depending from said auxiliary hoisting means, a ladle lifting beam suspended by said first plurality of ropefalls, said ladle lifting beam including a horizontally elongated member and a pair of parallel spaced ladle hooks depending from said elongated member, and an auxiliary hook suspended by said second plurality of ropefalls;

(b) positioning a scrap box containing solid scrap metal within the area serviced by said crane;

(c) extending said trailer frame outwardly from said trolley frame to permit said trolley to operate in its extended mode;

(d) moving said bridge and said trolley to position said trolley over said scrap box;

(e) lowering said ladle hooks and said auxiliary hook to attach said hooks to the trunnions of said scrap box;

(f) hoisting said scrap box, the long dimension of said scrap box being disposed substantially horizontally to avoid premature dumping of the contents of said scrap box;

(g) transporting said scrap box to a pouring point over the furnace to be serviced;

(h) raising said auxiliary hook to tilt said scrap box to cause the contents of said scrap box to empty into said furnace;

(i) transporting said scrap box away from said furnace and depositing said scrap box at a desired point within the area serviced by said crane;

(j) retracting said trailer frame inwardly toward said trolley frame to permit said trolley to operate in its retracted mode;

(k) positioning a hot metal transfer ladle within the area serviced by said crane;

(l) moving said bridge and said trolley to position said trolley over said ladle;

(m) lowering said ladle hooks and said auxiliary hook to attach said hooks to the trunnions of said ladle;

(n) hoisting said ladle in an upright position to avoid premature dumping of the contents of said ladle;

(o) transporting said ladle to a pouring point over the furnace to be serviced;

(p) raising said auxiliary hook to tilt said ladle to cause the contents of said ladle to empty into said furnace; and (q) transporting said ladle away from said furnace and depositing said ladle at a desired point within the area serviced by said crane.

* * * * *